United States Patent [19]

Hall

[11] Patent Number: 5,038,423

[45] Date of Patent: Aug. 13, 1991

[54] MOTORIZED CONVERTIBLE SEAT-BED

[75] Inventor: Rex D. Hall, White Pigeon, Mich.

[73] Assignee: Shrock Manufacturing, Inc., Elkhart, Ind.

[21] Appl. No.: 512,978

[22] Filed: Apr. 23, 1990

[51] Int. Cl.[5] ..... A47C 17/16; A47C 17/17

[52] U.S. Cl. ..... 5/37.1; 5/18.1; 5/48

[58] Field of Search ..... 5/37 R, 37 B, 37 C, 5/41, 47, 48, 18 R

[56] References Cited

U.S. PATENT DOCUMENTS

| | | | |
|---|---|---|---|
| 3,458,877 | 8/1969 | Edwards | 5/47 |
| 4,563,784 | 1/1986 | Shrock et al. | 5/47 |
| 4,654,902 | 4/1987 | Shrock et al. | 5/37 R |

*Primary Examiner*—Alexander Grosz
*Attorney, Agent, or Firm*—James D. Hall

[57] ABSTRACT

A motorized convertible seat-bed to electrically shift the seat-bed from between its seat position and its bed position. The seat-bed including a drive unit and a pair of mounting plates connected to a seat support and back support pivotally interconnected by a pivot pin. The drive unit including a worm gear and slide assembly having a worm gear follower wherein rotation of the worm gear causes the slide assembly to shift along a longitudinal track carried by the frame side of the seat bed. A pivoted drive arm is interconnected between the slide assembly and the pivot pin such that as the slide assembly is shifted from its fully extended position to its fully retracted position the drive arm applies an upward force on the pivot pin to pivot the plates and supports into a bed position. When the slide assembly is shifted to a fully extended position by the worm gear the hinged drive arm applies a downward force on the pivot pin to pivot the pivot plates and supports about the bolt and shift the seat-bed into its upright seat position.

6 Claims, 5 Drawing Sheets

MOTORIZED CONVERTIBLE SEAT-BED

BACKGROUND OF THE INVENTION

This invention relates to convertible seat-bed and will have special but no limited application to a motorized seat-bed as used in a van or other recreational vehicle.

It is common in the recreational vehicle industry to include a bench seat which is convertible into a bed and which is commonly referred to as a convertible seat-bed. A convertible seat-bed of the general type and construction which will be described herein is shown and described in U.S. Pat. No. 4,654,902, incorporated herein by reference.

In general, the '902 patent discloses a seat-bed having a mounting plate connected to the upright back part and a mounting plate connected to the horizontal seat part. The two mounting plates are secured to one another by a pivot pin. Pivotable links are connected between each mounting plate and the frame. The pivotable links are interlinked by a pivot arm. The pivotable links and interconnected pivot arm translate movement of the seat part to the back part when shifting between the seat or bed positions, thus requiring minimum effort on behalf of the user.

It is further common in the recreational vehicle industry to connect a motorized drive unit to a convertible seat-bed to automatically shift the seat-bed between its bed and seat positions. Such a drive unit is shown in U.S Pat. No. 4,463,784. Previous attempts to motorize the '902 seat-bed have proven unsatisfactory due largely in part to the pivot interconnection previously described.

SUMMARY OF THE INVENTION

The motorized seat-bed of this invention includes a drive unit which provides automation of the '902 seat-bed by applying force against a pivot point defined by the pivot pin interconnecting the two mounting plates. A drive arm extends from the pivot pin to a trunnion pin carried by a slide assembly shiftable along a track. A worm gear extends along the track. A worm gear follower is connected to the slide assembly to shift the assembly along the track as the worm gear rotates under the force of an electric motor. The shifting slide assembly forces to the mounting plate at their pivot point to shift the seat-bed between its seat and bed positions.

Accordingly, it is an object of this invention to provide for a motorized convertible seat-bed.

Another object of this invention is to provide for a drive unit for a seat-bed having pivotally interconnected mounting plates.

Other objects of this invention will become apparent upon a reading of the following description taken with the accompanying drawings.

DESCRIPTION OF THE PREFERRED EMBODIMENT

Figure 1:
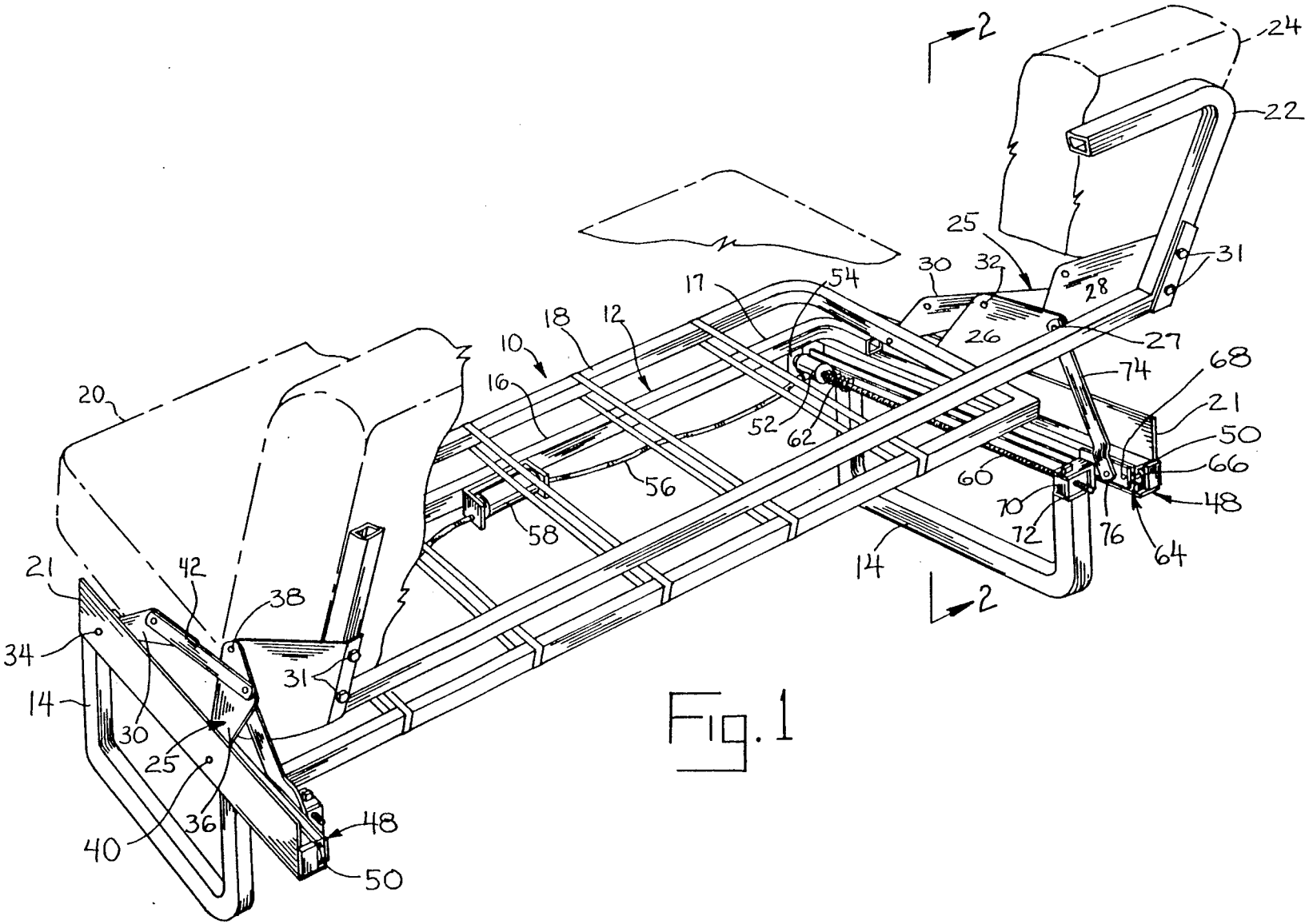
FIG. 1 is a perspective view of the motorized convertible seat-bed of this invention.

The preferred embodiment herein disclosed is not intended to be exhaustive or to limit the application to the precise form disclosed. Rather it is chosen and described to enable others skilled in the art to utilize its teachings.

Referring now to the figures motorized seat-bed 10 shown in the drawings includes a support frame 12 having spaced upright U-shaped supports 14 connected by a horizontal U-shaped frame member 16. Frame member 16 includes front frame part 17 and side frame parts 21. A seat support 18 carries a seat cushion 20 (shown in broken lines) and is supported by frame member 16. A back support 22 carries a back cushion 24 (shown in broken lines). Seat support 18 is connected to back support 22 by a pivot mechanism 25 located at each side of the seat-bed frame 12.

Each pivot mechanism 25 includes mounting plate 26 secured to the rear of seat support 18 by fasteners 29 and a mounting plate 28 secured to the lower end of back support 22 by fasteners 81. Mounting plates 26, 28 are secured to one another by pivot pin 27. A pivot arm 30 is connected at one end to seat support mounting plate 26 by pivot pin 32 and at its other end to frame part 16 by pivot pin 34. A pivot arm 36 is connected at one end to back support mounting plate 28 by pivot pin 38 and at its is other end to frame part 16 by pivot pin 40. An interconnecting pivot arm 42 is connected to pivot arms 80 and 36 at points located between the connections of the pivot arms to their respective mounting plate and the frame. Pivot pin 27 defines the pivot axis between mounting plates 26, 28. A more thorough and complete understanding of the pivot mechanisms 25 on each end of the seat-bed may be had by referring to U.S. Pat. No. 4,654,902, previously incorporated by reference.

A drive unit 48 is carried by each side frame part 21 and includes a longitudinal C-shaped channel 50 connected to and extending along inner side frame part 21. For simplicity only one drive unit 48 will be described as both drive units are identical in construction and operation. A gear unit 52 is connected to front frame part 17 by a bracket 54. The input of gear unit 52 is connected by a flexible shaft 56 to an electrical motor 58 carried by front frame part 17. The output of gear unit 52 is connected to a worm gear 60 which extends longitudinally along side frame part 21. A helical spring 62 secured at one end to gear unit 52 extends about worm gear 60 as illustrated. Drive unit 48 further includes a slide assembly 64 carried within channel 50 and including a pair of rollers 66 interconnected by a rigid metal strap 68. A worm gear follower 70 is connected by a bracket 72 to strap 68. A drive arm 74 is pivotally connected at one end to strap 68 by a pin 76 and at the other end to mounting plates 26 and 28 by pivot pin 27. As illustrated, drive arm 74 is offset slightly to be substantially parallel with mounting plates 26 and 28 at the point of its connection with the mounting plates.

Figure 2:
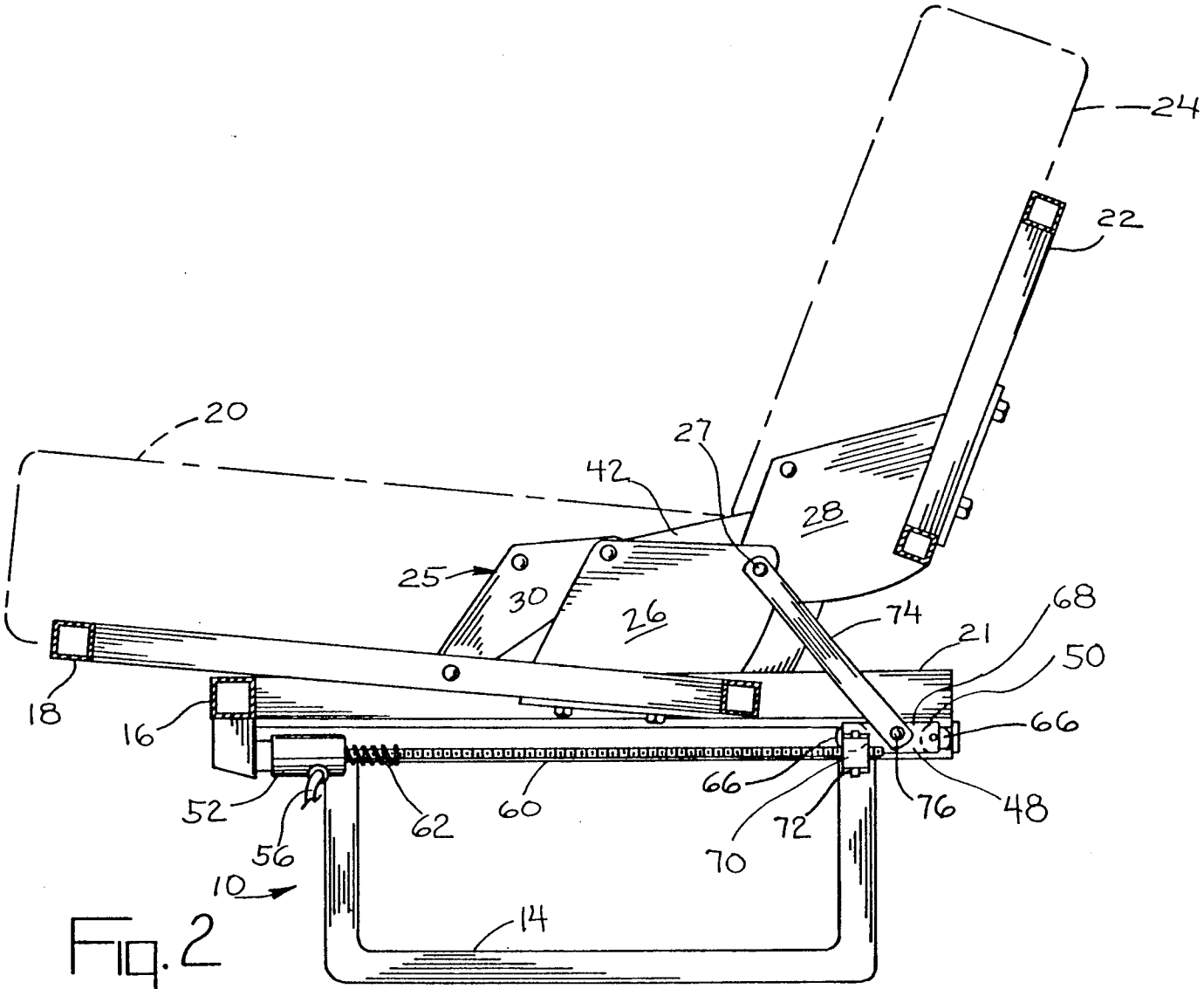
FIG. 2 is a sectional view seen along line 2—2 of FIG. 1.
Figure 3:
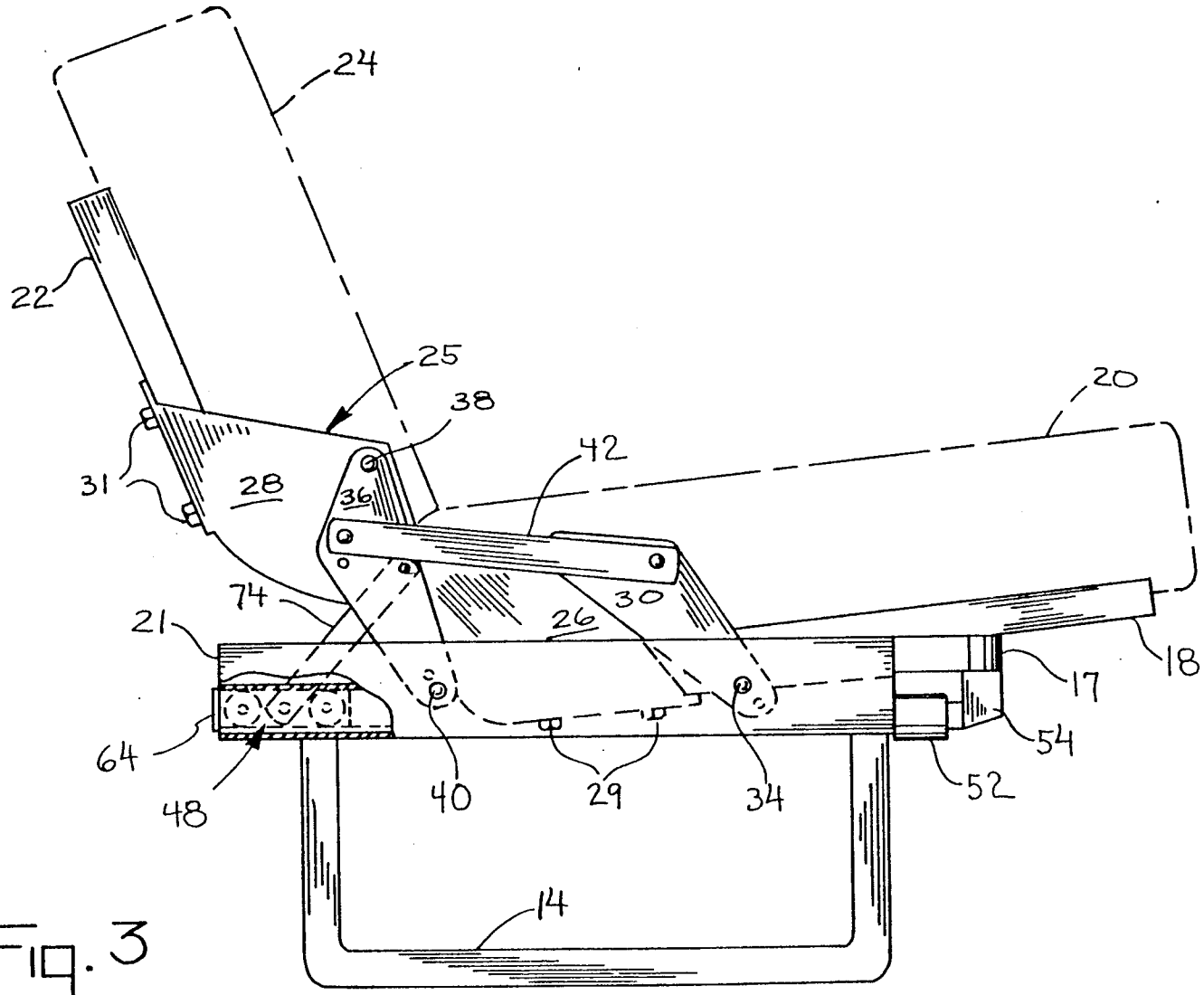
FIG. 3 is a side elevational view of the motorized seat-bed in a seat position with portions cut away to illustrate the orientation of the drive unit
Figure 4:
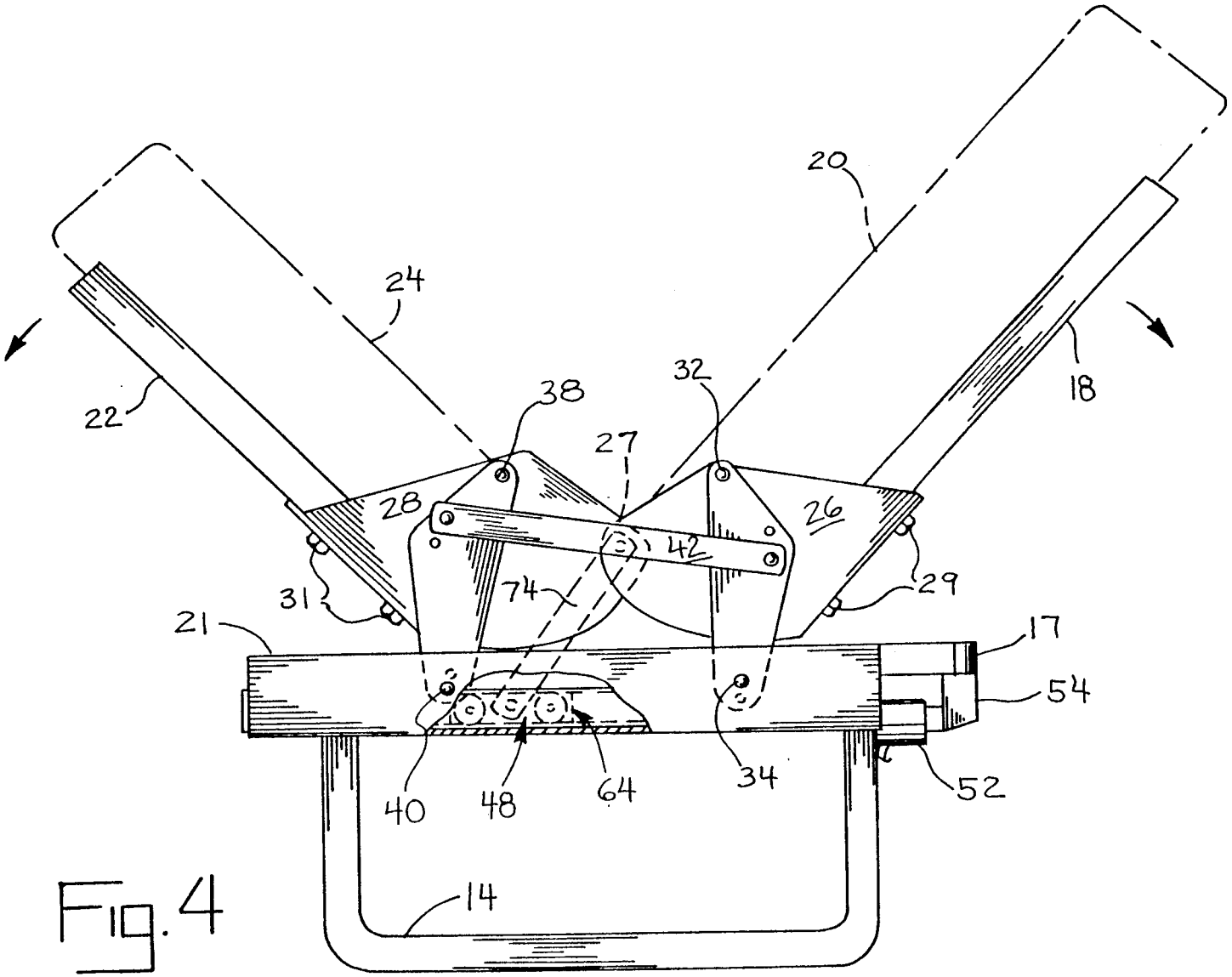
FIG. 4 is a side elevational view of the motorized seat-bed in an intermediate position with portions cut away to illustrate drive unit orientation.

In use with the seat-bed 10 initially in its upright or seat position illustrated in FIGS. 1 and 2, slide assembly 64 is at the far rearward end of channel 50. So positioned, drive arm 74 through its interconnection between slide assembly 64 and mounting plates 26, 28 locks the seat bed 10 into its seat position. When voltage is applied to motor 58, the flexible shaft 56 is rotated and through gear unit 52 causes worm gear 60 to rotate in a predetermined direction. Rotation of worm gear 60 in such direction causes worm gear follower 70 to be drawn toward gear unit 52 which draws the entire slide assembly 64 forward front frame part 17. Rollers 66 of slide assembly 64 are provided to permit the slide assembly to shift along channel 50 with reduced resistance. As the slide assembly is shifted from its fully extended or outward position of FIGS. 1 and 2 toward the gear unit, drive arm 74 through its connection by pivot pin 27 pushes generally upwardly on the pivot pin causing mounting plates 26, 28 to pivot about the pin. Through the interconnection of mounting plates 26, 28 with pivot arms 30, 36 and 42, back support 22 and seat support 18 are caused to pivot into the intermediate position of FIG. 4. FIG. 4 illustrates intermediate position of drive unit 48 and the resultant intermediate position of mounting plates 26, 28. Continued rotation of worm gear 60 by motor 58 draws slide assembly 64 further toward gear unit 52 which continues the upward movement of drive arm 74 to continue to pivot mounting plates 26, 28 about pin 27 into the fully horizontal or bed position illustrated in FIG. 5. It should therefore be understood that when shifting seat-bed 10 from the seat position into the bed position drive arm 74 exerts a continued upward force on the pivot pin 27. Spring 62 serves as a cushioning stops for gear follower 70

Figure 5:
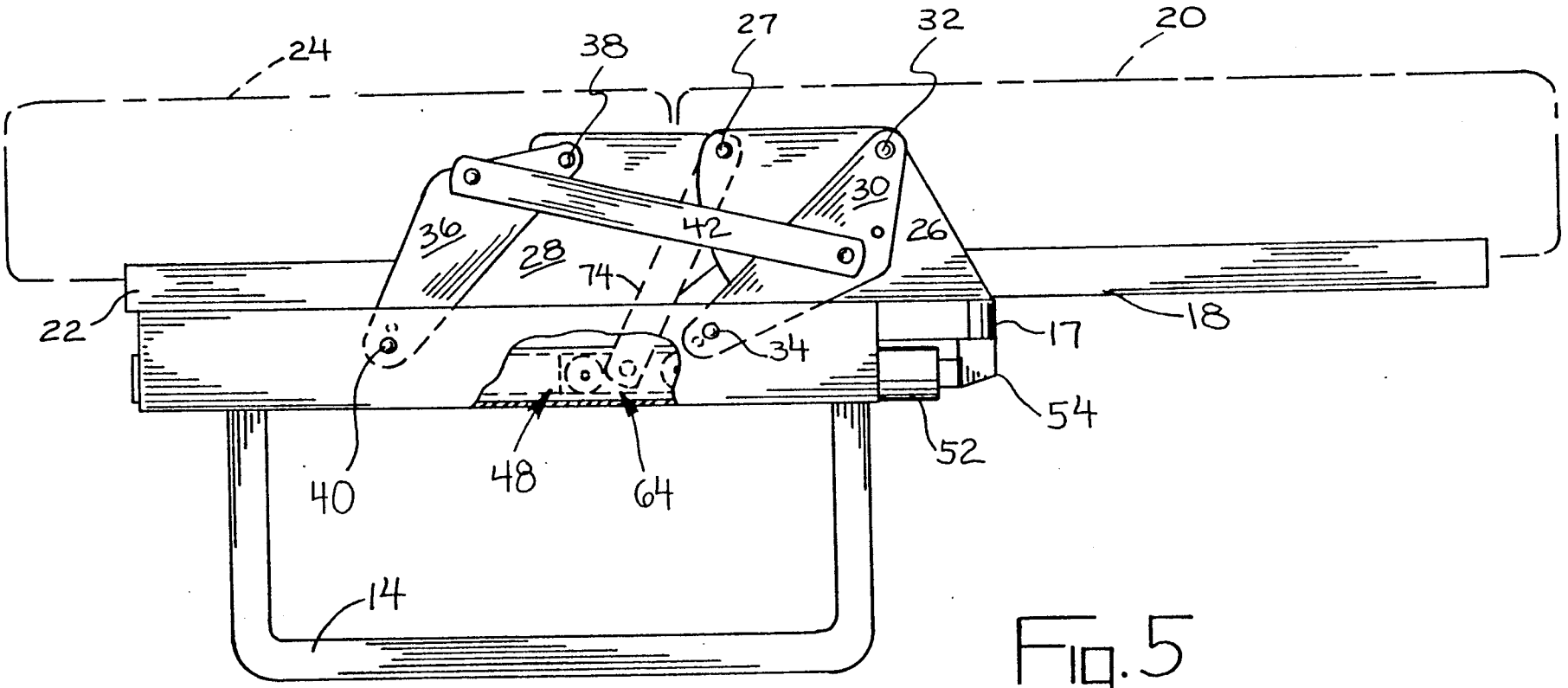
FIG. 5 is a side elevational view of the seat-bed in a bed position with portions cut away to illustrate drive unit orientation.

To convert the seat-bed 10 from its bed position of FIG. 5 into its seat position of FIGS. 1 and 2, the direction of rotation of motor 58 is reversed which translates into a reversed rotation of worm gear 60. As the slide assembly under influence of worm gear follower 70 is shifted outwardly away from gear unit 52, drive arm 74 pulls generally downwardly on pivot pin 27. As the slide assembly shifts farther away from gear unit 52, the drive arm 74 continues to pull on pin 27 to shift the seat-bed from its bed position into its seat position through the interconnection and linkage of pivot arms 30, 36 and 42. In is fully extended position of FIGS. 1 and 2, slide assembly 64 locks the seat bed 10 into is seat position by maintaining a downward pulling force on the pivot pin after motor 58 has stopped rotating.

It should be understood that although the preferred embodiment is depicted as having a direct linkage between the drive unit 48 and pivot pin 27 it is conceivable to add additional linkages between the drive unit and the pivot pin or connect the drive arm directly to a pivot plate adjacent the pivot pin. Therefore, the exact embodiment depicted is for illustrative purposes only and any drive unit associated with the seat-bed of U.S. Pat. No. 4,654,902 wherein the resultant force of the drive unit acts upon the pivot pin is contemplated by this invention, It should be further understood that the above description does not limit the invention to the precise form disclosed but may be modified within the scope of the appended claims.

I claim:

1. A convertible seat-bed including a frame (12), a seat support (18) for supporting a seat cushion (20) and a back support (22) for supporting a back cushion (24), pivot means (25) connected to said seat support (18) and said back support (22) for allowing movement of said seat and back supports between a seat position with said back support being generally upright and the seat support being generally horizontal and a bed position with said seat and back supports being generally horizontal, said pivot means (25) including a pivot plate (26) connected to said seat support (18) and another pivot plate (28) connected to said back support (22), said pivot plates (26, 28) being interconnected by a pivot pin (27), said pivot means (25) further including interconnected pivot members (30, 36) connected to said frame and pivot plates (26, 28) and a pivot arm (42) extending between said pivot members (30, 36) to transfer movement of one pivot plate to the other pivot plate, and a drive unit (48) carried by said frame including drive means (64) shiftable along said frame, said drive means (64) connected to said pivot means (25) for acting on the pivot pin (27) to shift said pivot plates (26, 28) relative to each other and urge said seat and back supports between their seat and bed positions.

2. The seat-bed of claim 1 wherein said drive means is connected to said pivot pin.

3. The seat-bed of claim 2 wherein said drive means is connected to said pivot pin by a drive arm.

4. The seat-bed of claim 3 said drive means further includes a follower connected to a rotatable worm gear, said drive arm being connected between said follower and said pivot pin, wherein said drive unit applies a force through said drive arm to said pivot pin generally away from said follower to shift said seat and back supports into said bed position.

5. The seat-bed of claim 4 wherein said drive means further includes a channel carried adjacent a side of said frame and including a fore end and an aft end, said follower carried by said channel and shiftable along said channel responsive to said worm gear, wherein as said worm gear shifts said follower toward said channel fore end said drive arm pushes generally upwardly against said pivot pin, as said worm gear shifts said follower toward said channel aft end said drive arm pulls said pivot pin generally downwardly.

6. A drive unit (48) for a convertible seat-bed (10), said seat-bed including a seat support (18) for supporting a seat cushion (20) and back support (22) for supporting a back cushion (24), pivot means (25) connecting said seat support (18) and said back support (22) to a frame for allowing pivotal movement of said seat and back supports between a seat position wherein said back support (22) being generally upright and the seat support (18) being generally horizontal, and a bed position wherein said seat and back supports are generally horizontal, said drive unit (48) comprising a means carried by said frame for pushing against said pivot means (25) to shift said seat-bed from its bed position to its seat position and pulling on said pivot means (25) to shift said seat-bed from its bed position into its seat position.

* * * * *